US005669079A

United States Patent [19]

Morgan

[11] Patent Number: 5,669,079

[45] Date of Patent: Sep. 23, 1997

[54] SAFETY ENHANCED MOTORCYCLE HELMET

[76] Inventor: Don E. Morgan, 33 Kingsley Parade, Yeronga, Queensland, Australia, 4104

[21] Appl. No.: 634,764

[22] Filed: Apr. 19, 1996

[51] Int. Cl.[6] ..... A42B 3/00

[52] U.S. Cl. ..... 2/414; 2/412

[58] Field of Search ..... 2/410, 411, 412, 2/413, 414, 425

[56] References Cited

U.S. PATENT DOCUMENTS

| | | | |
|---|---|---|---|
| 4,016,734 | 4/1977 | Morton | 2/413 |
| 4,064,565 | 12/1977 | Griffiths | 2/412 |
| 4,290,149 | 9/1981 | Aileo | 2/414 |
| 4,432,099 | 2/1984 | Grick et al. | 2/414 |
| 4,586,200 | 5/1986 | Poon | 2/413 |
| 4,627,114 | 12/1986 | Mitchell | 2/414 |
| 5,309,576 | 5/1994 | Broersma | 2/412 |

*Primary Examiner*—Michael A. Neas
*Attorney, Agent, or Firm*—H. Jay Spiegel

[57] ABSTRACT

Embodiments of a safety enhanced motorcycle helmet provide enhanced cushioning to protect sensitive areas of the user's head. In each embodiment, a high density foam material is provided just under the thick outer shell of the helmet. The various embodiments contemplate embedding of various designs of low density foam materials within the high density foam layer. Embodiments include strips of low density foam, low density cylindrical foam plugs, channels formed within the high density foam layer and containing low density foam balls, and low density foam wedge plugs.

20 Claims, 5 Drawing Sheets

SAFETY ENHANCED MOTORCYCLE HELMET

BACKGROUND OF THE INVENTION

The present invention relates to a safety enhanced motorcycle helmet. Helmets that are currently employed by drivers of motorcycles and in other environments of use do not effectively absorb impact forces nor do they properly decelerate and spread blows from the point of impact. D. Larder conducted research in 1984 concerning foam liners of helmets and found that in 44% of the helmets examined, no impact damage to the foam liner could be found, indicating a need to use softer liner material in a helmet. (Larder, D. (1984) *Analysis of Crash Helmets Involved in Fatal Motorcycle Accidents,* Accident Research Unit, University of Birmingham). In research conducted by J. P. Corner, C. W. Whitney, N. O'Rourke, and the Applicant herein, *Motorcycle and Bicycle Protective Helmets—Requirement Resulting from a Post Crash Study and Experimental Research,* Report No. CR 55, Federal Office of Road Safety, Canberra, Australia, the authors found that motorcycle helmet foam liners are too stiff and hard and produce distortion or inbending of the head when an impact force is applied to the helmet. Their post-crash analysis and evaluation of helmets that had been in crashes involving impacts to the helmets revealed very little crushing of the foam liner of the helmet indicating that the density of the foam ought to be reduced. In the study, the authors stated that "the human head deforms elastically on impact" and "As significant elastic deformation of the head can result in brain damage it would be preferable to have a softer liner material in the helmet so that less deformation of the head occurred." As is known, distortions of the human head beyond 1 to 2 mm can cause intracranial damage.

In a typical motorcycle helmet, the thickness of the shell of the helmet in the temple area of the user's head is about 4 mm, whereas the thickness of the foam liner is in the range of 12 to 30 mm. As is well known, the temporal area of the human skull is a zone of weakness. Bone tests have indicated that bone in the temporal region of the human head has only ½ to ⅓ the strength as compared to other areas of the human skull. Since a significant number of impacts occur in the temporal region, it is imperative that motorcycle helmets be designed to account for this fact.

In a further aspect, it would not be appropriate to design a motorcycle helmet employing a foam layer entirely of low density foam. Such a helmet liner would be too soft and resilient, would cause the helmet to move with respect to the user in an undesirable fashion and would not be sufficiently durable enough to provide a reasonable useful life for the helmet.

It is with these problems and concerns in mind that the present invention was developed.

SUMMARY OF THE INVENTION

The present invention relates to a safety enhanced motorcycle helmet. The present invention includes the following interrelated objects, aspects and features:

(1) In a first aspect, the inventive motorcycle helmet has an outer shell designed to cover the head of the user and having a front opening allowing the user appropriate visibility.

(2) Within the outer shell, a liner is provided and is disclosed in numerous embodiments. In each embodiment, a high density foam layer is provided and is accompanied by a particular desirable configuration of low density foam. In each embodiment, an inner layer of material known as "BUBBLE WRAP" is employed for direct engagement with the head of the user.

(3) In a first embodiment, the low density foam aspect consists of a multiplicity of foam impact strips embedded within the high density foam layer.

(4) In a second embodiment, the low density foam aspect consists of a multiplicity of low density cylindrical foam plugs embedded within the high density foam layer but terminating short of the inner "BUBBLE WRAP" layer.

(5) In a third embodiment, channels are provided within the high density foam layer which are filled with low density foam balls.

(6) In a fourth embodiment, low density foam wedges are embedded within the high density foam layer with their apices spaced from the inner "BUBBLE WRAP" layer.

As such, it is a first object of the present invention to provide a safety enhanced motorcycle helmet.

It is a further object of the present invention to provide such a device including a high density foam layer embedded with a particular configuration of low density foam.

It is a still further object of the present invention to provide such a device incorporating an inner layer made of a "BUBBLE WRAP" material.

It is a yet further object of the present invention to provide such a device with low density foam cylindrical plugs.

It is a still further object of the present invention to provide such a device including low density foam wedges.

It is a still further object of the present invention to provide such a device including channels filled with low density foam balls.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
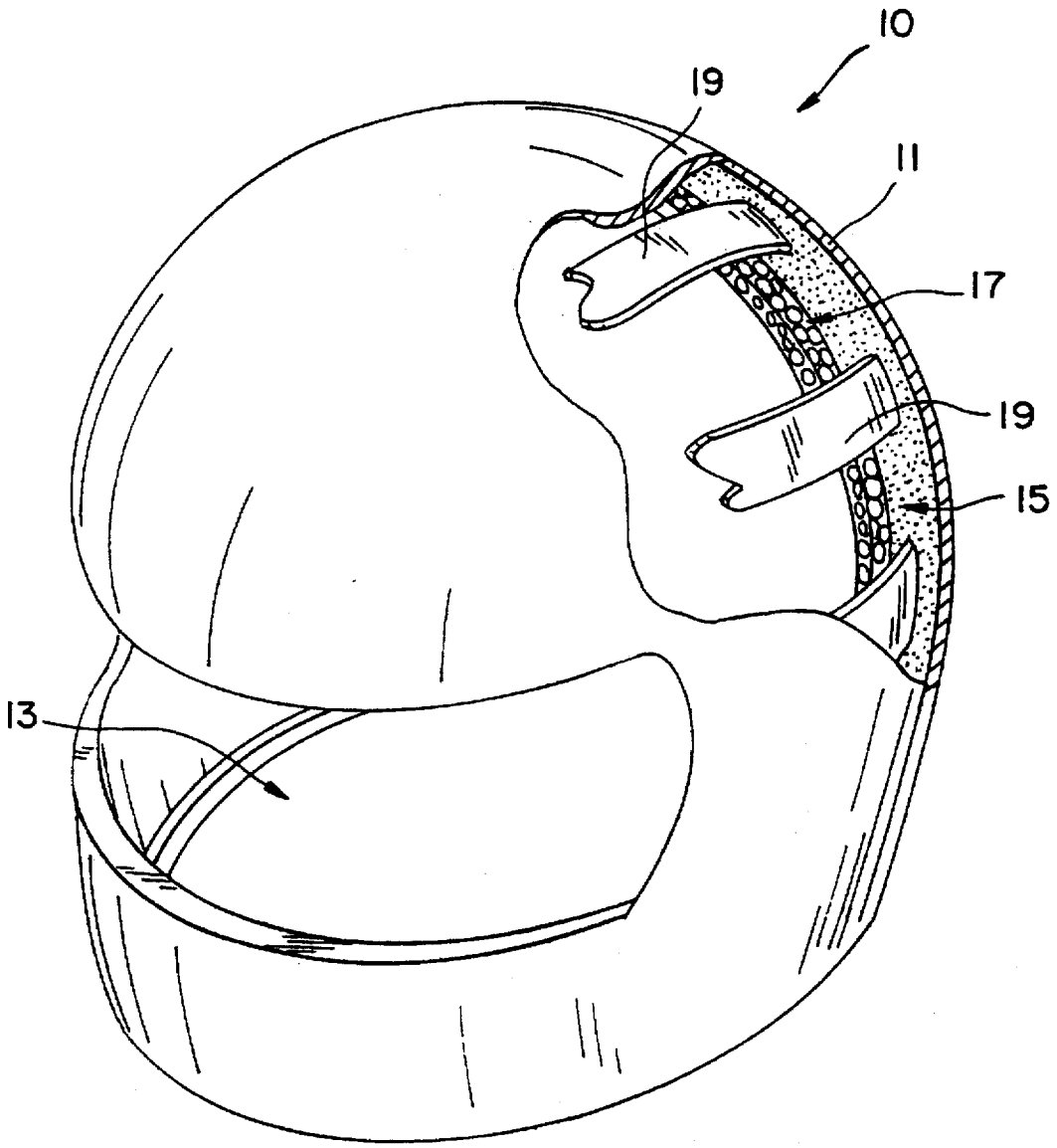
FIG. 1 shows a perspective view of a first embodiment of the present invention with portions broken away and in partial cross-section to show detail.

With reference, first, to FIGS. 1–5, a motorcycle helmet is generally designated by the reference numeral 10 and is seen to include an outer shell 11 preferably made of a hard plastic material and including an opening 13 allowing the user to see outside the helmet 10.

With particular reference to FIG. 1, it is seen that within the outer shell 11, shock absorbing padding is provided including an outer layer 15 consisting of high density foam such as, for example, polystyrene foam. An inner layer 17 is provided which comprises a flexible pad product known as "BUBBLE WRAP", which product is most commonly seen as flat sheets of plastic having air bubbles incorporated therein and commonly used as an impact absorbing packing material. Applicant is unaware of the use of "BUBBLE WRAP" in the environment of use contemplated herein. In the preferred embodiment, two layers 17 of "BUBBLE WRAP" are provided. As also seen in FIG. 1, the high density foam layer 15 has embedded therein a multiplicity of foam members comprising strips 19 of low density foam. As shown in FIG. 1, the strips 19 are embedded within the outer foam layer 15 about half-way through the thickness thereof so that the strips 19 are spaced from the inner "BUBBLE WRAP" layer 17. The low density foam strips 19 are spaced from the "BUBBLE WRAP" layer 17 to allow them to perform a cushioning function independently of the cushioning function provided by the "BUBBLE WRAP" layer 17.

Figure 2:
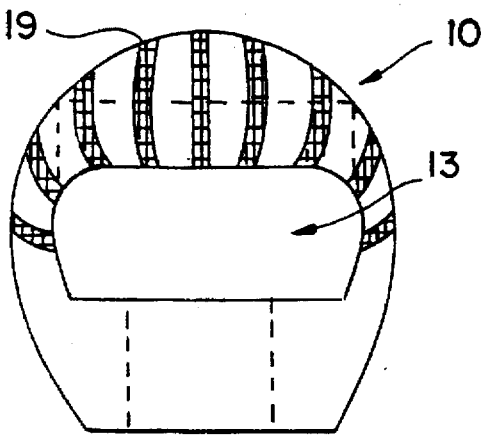
FIGS. 2, 3, 4 and 5 show front, rear, side and other side views, respectively, of the embodiment of FIG. 1 showing the locations of impact absorbing strips incorporated therein.
Figure 3:
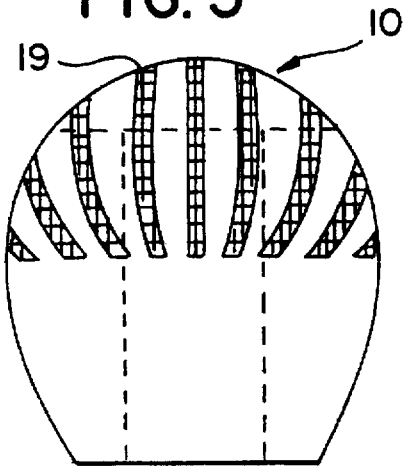
Figure 4:
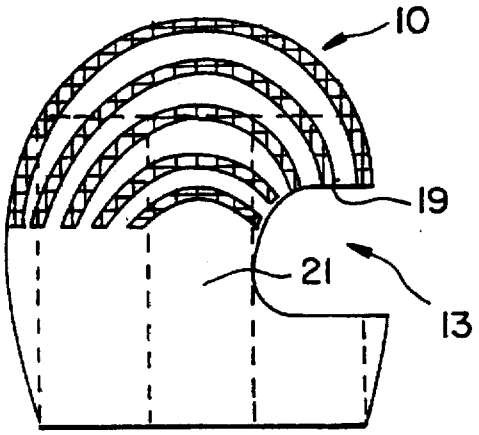

FIGS. 2–4 show a schematic representation of the patterns of the strips 19 within the layer 15 of the helmet 10. The strips 19 are only shown schematically in FIGS. 2–5 and, in fact, in the inventive helmet 10, there are a larger number of strips more closely spaced than is shown in these figures.

Figure 5:
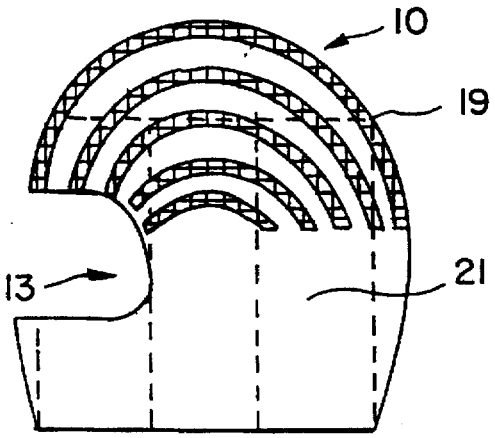

FIGS. 2–5 also show different regions of the helmet which are self-evident from knowledge of anatomy. The region 21 on either side of the helmet, as best seen in FIGS. 4 and 5, is the temporal region where a higher frequency of strips 19 is normally provided to provide additional cushioning and protection.

In the preferred embodiment of the present invention, the strips 19 have a density of from 25 to 30 kg/m$^3$, widths of about 20 mm and thicknesses of about 10 mm. In the preferred embodiment, adjacent strips 19 are spaced from one another by a distance of between 20 to 25 mm.

Figure 6:
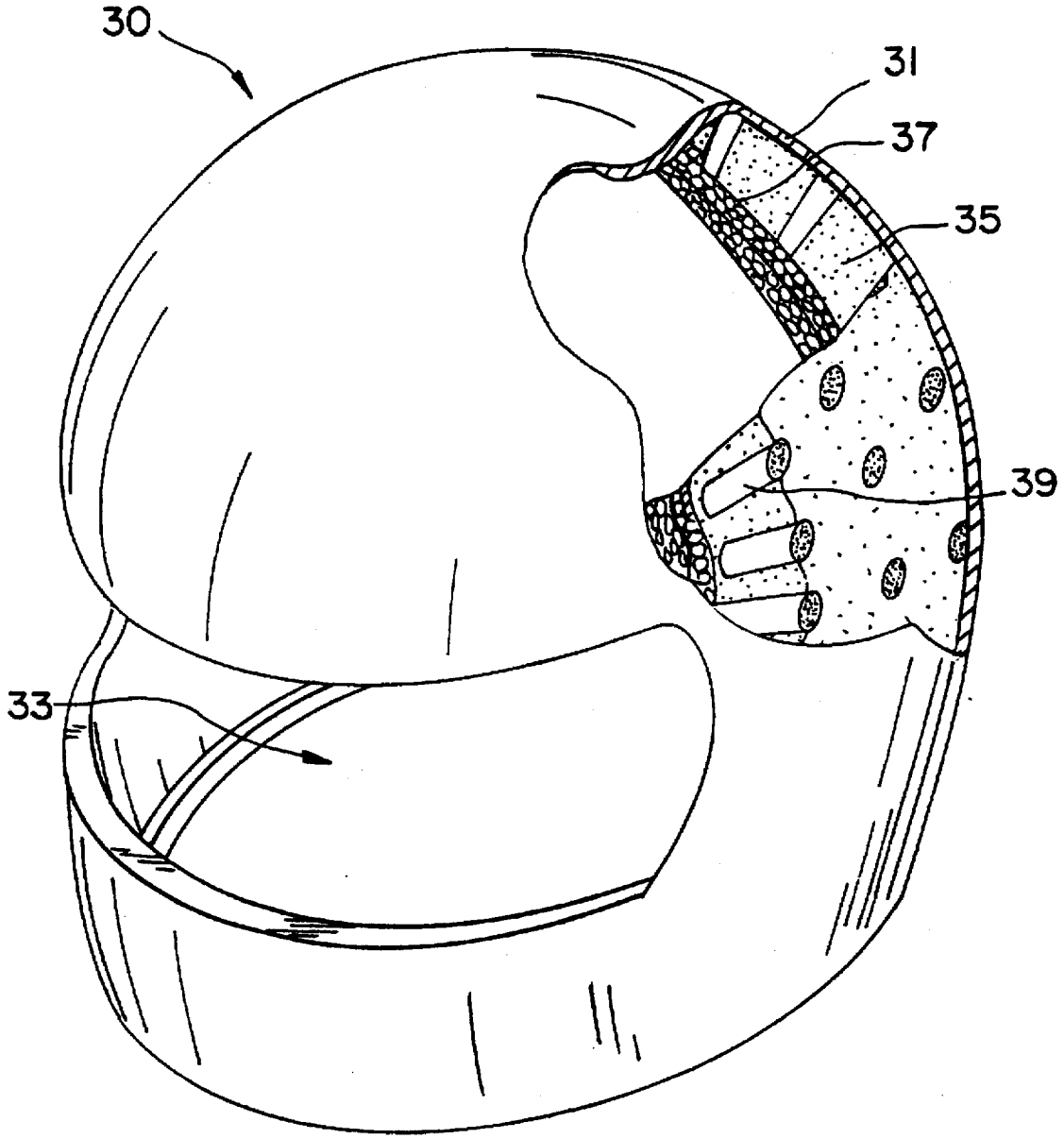
FIG. 6 shows a perspective view with portions broken away and partially in cross-section of a second embodiment of the present invention.

FIG. 6 shows a second embodiment of the present invention with the helmet thereof generally designated by the reference numeral 30 and including a hard plastic outer shell 31 including an opening 33 to allow the user to see out of the helmet 30. The inventive padding consists of a high density foam layer 35 and an inner "BUBBLE WRAP" layer 37. A multiplicity of foam members comprising generally cylindrical foam plugs 39, each made of a low density foam material, are embedded within the high density foam layer 35. As best seen with respect to the cylindrical foam plug 39 to which the reference numeral and lead line are directed, the inner termination of each foam plug is at least slightly spaced from the "BUBBLE WRAP" layer 37 to allow each plug to provide a cushioning effect independent of the cushioning provided by the "BUBBLE WRAP" layer 37.

In the preferred embodiment, the plugs 39 should have a density of 25 to 30 kg/m$^3$, a diameter of 10 mm, should be flush with the outer surface of the high density foam layer 35 and should be spaced about 2 mm from the "BUBBLE WRAP" layer 37. Additionally, it is preferred that the plugs 39 be spaced from one another by a distance of approximately 30 mm in each direction. Of course, if desired, in the temporal region of the high density foam layer 35, the concentration of the plugs 39 may be increased so that they are spaced from one another by a distance of only 20 mm.

Figure 7:
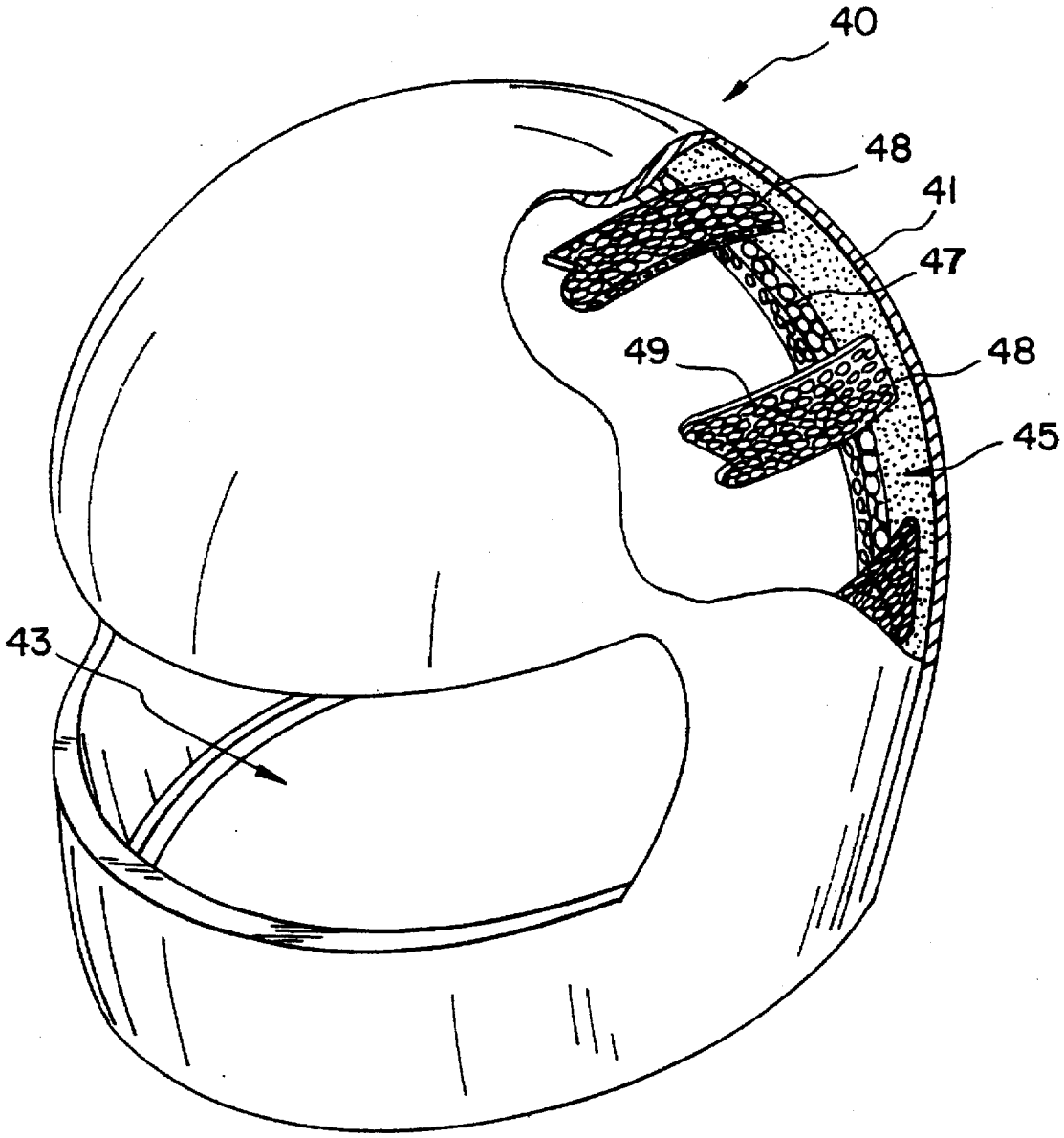
FIG. 7 shows a perspective view with portions broken away and partially in cross-section of a third embodiment of the present invention.

With reference to FIG. 7, a third embodiment of the present invention is seen to include a helmet generally designated by the reference numeral 40 and including a hard plastic outer shell 41 and an opening 43 allowing the user to see therefrom. The inventive padding consists of a high density outer foam layer 45 having a multiplicity of channels 48 formed therein, each of which is filled with a multiplicity of foam members comprising low density foam balls 49 having a density of 25 to 30 kg/m$^3$. Within the outer high density foam layer 45, an inner layer 47 of "BUBBLE WRAP" material is provided. As seen in FIG. 7, the channels 48 are spaced between the outer shell 41 and the "BUBBLE WRAP" layer 47 so that the low density foam balls provide a cushioning effect independent of that which is provided by the "BUBBLE WRAP" layer 47.

Figure 8:
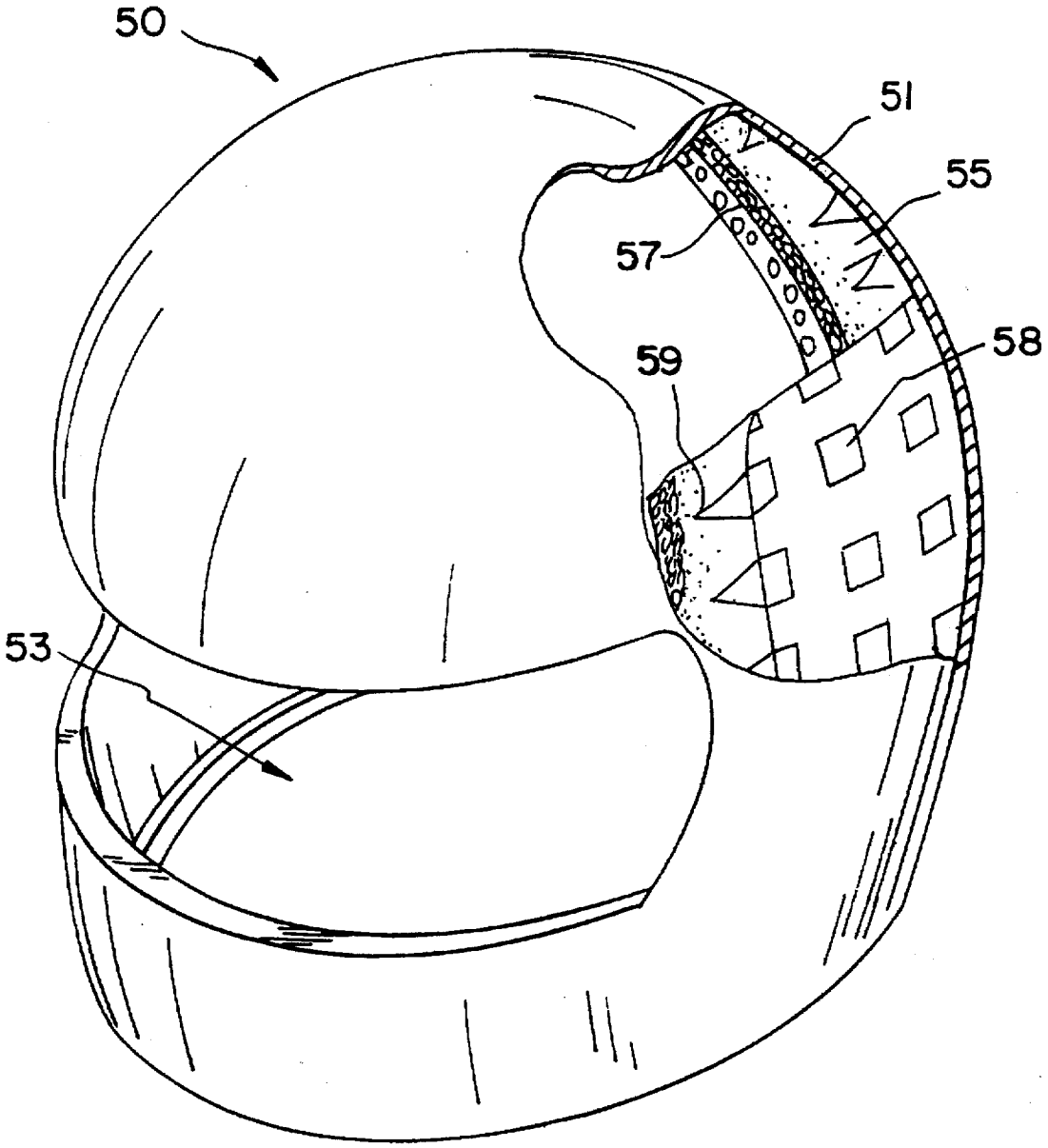
FIG. 8 shows a perspective view with portions broken away and partially in cross-section of a fourth embodiment of the present invention.

With reference to FIG. 8, a fourth embodiment of the present invention is generally designated by the reference numeral 50 and is seen to include a hard outer shell 51 and an opening 53 allowing the user to see from the helmet 50. Within the shell 51, an outer high density foam layer 55 is provided as is an inner layer 57 of "BUBBLE WRAP" material. As seen in FIG. 8, embedded within the high density foam layer 55 are a multiplicity of foam members comprising low density foam wedges 58 having a density of 25 to 30 kg/m$^3$ and having apices 59 within the high density foam layer 55 but spaced from the "BUBBLE WRAP" layer 57 so that the low density foam wedges 58 perform their cushioning function independent of that which is provided by the "BUBBLE WRAP" layer 57.

In a similar fashion to that which is described above concerning the embodiment of FIG. 6, the wedges 58 may be spaced from one another by about 30 mm in all directions except that in the temporal region of the liner 55, the wedges 58 may be spaced from one another more closely, for example, by 20 mm in all directions. Additionally, the apices 59 of the wedges 58 are preferably spaced about 2 mm from the "BUBBLE WRAP" layer 57.

In each of the embodiments of the present invention, the cushioning element embedded within the outer high density foam layer is made of a material such as, for example, low density polystyrene plastic foam. In each of the embodiments, the high density foam preferably has a density of 45 to 50 kg/m$^3$.

In all of the embodiments described above, the inner layer may consist of two layers of "BUBBLE WRAP" material, each of which is about 10 mm in thickness. When two such layers are provided, bubbles in one layer generally fit between spaces between bubbles in the other layer thereby providing a more effective cushioning layer.

Each of the embodiments of the present invention provides enhanced safety for the user. The incorporation of low density foam inserts within the high density foam layer substantially reduces the overall stiffness of the high density foam layer thereby reducing skull deformation in a crash situation. If desired, the high density foam layer may be provided thicker in the temporal region of the helmet where most impact forces occur. Such a feature allows the liner to absorb and distribute impact forces over a larger area and facilitates deceleration of the blow at the point of impact.

In each of the embodiments of the present invention disclosed herein, the hard outer shell of the helmet may be made of any suitable hard material such as, for example, fiberglass, KEVLAR, carbon fiber, hard plastic, etc.

The use of low density foam inserts within the high density foam layer substantially reduces the entire weight of the helmet thereby reducing the effects of rotational acceleration of the head in a crash situation. Spacing of the inserts from the "BUBBLE WRAP" layer maintains the independence of the cushioning effect of each. The low density foam inserts disclosed herein are merely exemplary of the types of inserts that may be employed.

While maintaining a large percentage of the high density foam layer, the essential strength of a helmet is maintained.

Of course, the teachings of the present invention are applicable to all types of protective helmets including bicycle helmets, football helmets, snowmobile helmets and the like.

As such, an invention has been described in terms of preferred embodiments thereof which fulfill each and every one of the objects of the invention as set forth hereinabove and provide a new and useful safety enhanced motorcycle helmet of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A safety enhanced helmet, comprising:

a) an outer hard shell;

b) an inner cushioning padding including:

i) an outer layer consisting of a relatively high density foam layer extending inwardly from within said shell;

ii) an inner layer consisting of a flexible pad embedded with air bubbles; and iii) a plurality of relatively low density foam members embedded within said outer layer and spaced from said inner layer.

2. The helmet of claim 1, wherein said foam members comprise cylindrical plugs.

3. The helmet of claim 1, wherein said foam members comprise foam strips.

4. The helmet of claim 1, wherein said foam members comprise foam balls received within channels formed within said outer layer.

5. The helmet of claim 1, wherein said foam members comprise foam wedges.

6. The helmet of claim 1, wherein said foam members engage said shell.

7. The helmet of claim 1, wherein said inner layer comprises two layers.

8. The helmet of claim 1, wherein said outer layer is made of relatively high density polystyrene foam.

9. The helmet of claim 8, wherein said foam members are made of relatively low density polystyrene foam.

10. The helmet of claim 2, wherein said plugs are spaced from one another by about 20 mm in a temporal region of said helmet.

11. The helmet of claim 5, wherein said wedges are spaced from one another by about 20 mm in a temporal region of said helmet.

12. The helmet of claim 1, wherein said foam members have a density of 25–30 $kg/m^3$ and said outer layer has a density of 45–50 $kg/m^3$.

13. The helmet of claim 4, wherein said balls have a diameter of about 5 mm.

14. The helmet of claim 1, wherein said shell has a front opening.

15. A safety enhanced helmet, comprising:

a) an outer hard shell having a front opening;

b) an inner cushioning padding including:

i) an outer layer consisting of a relatively high density foam layer extending inwardly from within said shell;

ii) an inner layer consisting of a flexible pad embedded with air bubbles; and iii) a plurality of relatively low density foam members embedded within said outer layer, said foam members having a density of 25–30 $kg/m^3$ and being spaced from one another by about 20 mm in a temporal region of said helmet, said foam members being spaced from said inner layer.

16. The helmet of claim 15, wherein said foam members comprise cylindrical plugs.

17. The helmet of claim 15, wherein said foam members comprise foam strips.

18. The helmet of claim 15, wherein said foam members comprise foam balls received within channels formed within said outer layer.

19. The helmet of claim 15, wherein said foam members comprise foam wedges.

20. The helmet of claim 15, said foam members engaging said shell.

* * * * *